United States Patent [19]

Ogawa et al.

[11] 4,420,512

[45] Dec. 13, 1983

[54] EMULSION TYPE SIZING AGENT FOR CARBON FIBERS, PROCESS FOR ITS PREPARATION, AND METHOD FOR USING SAME

[75] Inventors: Hiroyasu Ogawa, Mishima; Mikio Shima, Shizuoka, both of Japan

[73] Assignee: Toho Belson Co., Ltd., Tokyo, Japan

[21] Appl. No.: 415,198

[22] Filed: Sep. 7, 1982

[30] Foreign Application Priority Data

Sep. 7, 1981 [JP] Japan ..... 56-139701

[51] Int. Cl.[3] ..... B05D 3/02

[52] U.S. Cl. ..... 427/386; 252/52 A; 427/379; 427/385.5; 523/205; 523/403; 523/406; 523/414; 523/424; 523/454; 523/456

[58] Field of Search ..... 252/8.9, 49.5, 52 A; 523/403, 406, 414, 424, 454, 205, 456; 427/379, 384, 386, 113, 112, 385.5

[56] References Cited

U.S. PATENT DOCUMENTS

| | | | |
|---|---|---|---|
| 2,872,427 | 2/1959 | Schroeder | 523/403 X |
| 3,945,964 | 3/1976 | Hastings et al. | 523/406 |
| 4,073,762 | 2/1978 | Hosoda et al. | 523/403 |
| 4,219,457 | 8/1980 | Taniguchi et al. | 523/427 |
| 4,360,608 | 11/1982 | Hijikata et al. | 523/456 X |

*Primary Examiner*—Thurman K. Page

*Attorney, Agent, or Firm*—Sughrue, Mion, Zinn, Macpeak, and Seas

[57] ABSTRACT

An aqueous emulsion type sizing agent for carbon fibers is disclosed. The sizing agent contains a compound represented by the following general formula (I):

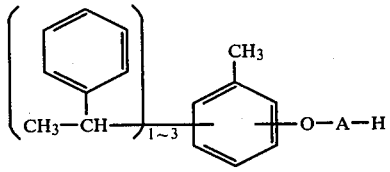

(I)

wherein A represents $(C_2H_4O)_l$ or $(C_2H_4O)_n(C_3H_6O)_m$[l is 18 to 70; n is 18 to 70; and m is 2 to 50 $(1 \leqq n/m \leqq 35)$];

a compound represented by the following general formula (II):

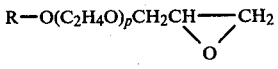

(II)

wherein R represents $C_qH_{2q+1}$ or

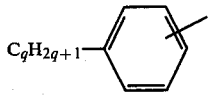

(q is 10 to 18; and p is 15 to 70); and an epoxy resin, a process for preparation of the agent, and the method for using it are also disclosed. The sizing agent has excellent emulsion stability and heat stability, and it can impart excellent bundling properties to carbon fibers.

20 Claims, No Drawings

EMULSION TYPE SIZING AGENT FOR CARBON FIBERS, PROCESS FOR ITS PREPARATION, AND METHOD FOR USING SAME

FIELD OF THE INVENTION

This invention relates to an emulsion type sizing agent for carbon fibers and, more particularly, to a sizing agent which has excellent emulsion stability, which improves bundling properties of carbon fibers, has excellent heat stability, and which, when used for treating carbon fibers, can improve physical properties of a composite material containing the treated carbon fibers.

BACKGROUND OF THE INVENTION

Carbon fibers are generally produced in the form of filaments or a tow (a bundle of several hundreds to several hundred thousands of filaments). The filaments or tow are usually used in the form of a sheet or tape produced by disposing the filaments in one direction and adhesion-processing them, woven or knitted fabric, etc. Alternatively, they may be used by cutting them into a length of several mm to several tens of mm. During processing steps for obtaining these fiber products, the use of carbon fibers in an as-produced form is liable to cause fluffing, leading to inferiority in handling. In order to prevent carbon fibers from fluffing, a sizing agent is usually applied to the carbon fibers to increase their bundling properties.

Sizing agents for carbon fibers are classified into two types. One type is a solution type as described in, for example, U.S. Pat. Nos. 3,806,489, 3,914,504 and 3,837,904. The solution type is comprised of an organic resin such as polyvinyl alcohol, vinyl acetate polymer, acrylic polymer, polyurethane, epoxy resin or polystyrene dissolved in an organic solvent. The other type is an emulsion type as described in, for example, U.S. Pat. No. 4,219,457, which comprises the above-described organic resin dispersed in water with the aid of an emulsifier. The solution type sizing agents require a large amount of organic solvent, and hence they are disadvantageous from the standpoints of economy, safety, and hygiene. Accordingly, emulsion type sizing agents are ordinarily used.

When depositing an emulsion type sizing agent onto carbon fibers, agents which have a solid concentration of about 0.1% to about 15% are employed in some cases. Sizing agents having such a low solid concentration have inferior emulsion stability (or emulsification stability). Furthermore, when applying emulsified particles onto carbon fibers having a low surface energy by using an emulsion type sizing agent for sizing, application specks are often created. Therefore, only fiber bundles with poor bundling properties are obtained. Furthermore, the heat stability of the sizing agent is decreased by the effects of the emulsifying agent used. This leads to deterioration of the physical properties of a carbon fiber-reinforced composite material obtained. These effects are caused by using carbon fibers which have been treated with these types of sizing agents, and, for example, a thermosetting or thermoplastic resins as a matrix material.

SUMMARY OF THE INVENTION

An object of the present invention is to provide a sizing agent for carbon fibers, which is excellent in emulsion stability and heat stability, a process for its preparation, and a method for using it.

Another object of the present invention is to provide a sizing agent for carbon fibers, which can impart excellent bundling properties to carbon fibers, a process for its preparation, and a method for using it.

A further object of the present invention is to provide a sizing agent for carbon fibers, which can improve the physical properties of a composite material containing carbon fibers sized with the sizing agent, a process for its preparation, and a method for using it.

The sizing agent of the present invention is an aqueous emulsion type sizing agent for carbon fibers, which contains:

a compound represented by the following general formula (I):

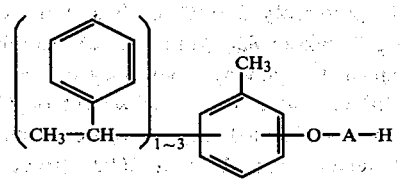

(I)

wherein A represents $(C_2H_4O)_l$ or $(C_2H_4O)_n(C_3H_6O)_m$ [l is 18 to 70; n is 18 to 70; and m is 2 to 50 ($1 \leqq n/m \leqq 35$)];

a compound represented by the following general formula (II):

$$R-O-(C_2H_4O)_p-CH_2-\underset{\diagdown O \diagup}{CH}-CH_2 \quad \text{(II)}$$

wherein R represents $C_qH_{2q+1}$ or

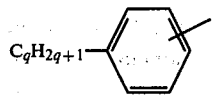

(q is 10 to 18; and p is 15 to 70); and an epoxy resin.

DETAILED DESCRIPTION OF THE INVENTION

With respect to compounds represented by the general formula (I) wherein A represents an ethylene oxide polymer, the number of moles of added ethylene oxide (l) is 18 to 70. If the number of moles is less than 18 or more than 70, the emulsion stability tends to deteriorate due to a reduction in emulsifying power. Similarly, where A represents a block polymer of ethylene oxide and propylene oxide, the number of moles of added ethylene oxide (n) must be within the range of 18 to 70, and the number of moles of added proopylene oxide (m) must be within the range of 2 to 50, with n/m being adjusted to be $1 \leqq n/m \leqq 35$, preferably $10 \leqq n/m \leqq 25$. The desired emulsion stability cannot be obtained unless all of these conditions are satisfied.

The oxyalkylene moiety A in the compound of the foregoing general formula (I) is either an ethylene oxide polymer or a block polymer of ethylene oxide and propylene oxide. Particularly good emulsion stability can be obtained by properly selecting the number of moles of the added alkylene oxide depending upon the particular epoxy resin used. When an epoxy resin having a large molecular weight or a large viscosity is used, good emulsion stability of a sizing agent having a solid concentration (total wt% of substances other than water and solvent) as low as 1 to 2% can be obtained by raising the number of added moles. In order to obtain a sizing agent having a particularly high stability, a suitable number of moles of added alkylene oxide can be determined by preparing sizing agents using compounds of the general formula (I) having different numbers of added alkylene oxide and allowing them to stand in order to determine the amount of precipitated solids. The amount of precipitated solids formed when allowed to stand at 25° C. for one day is preferably not more than 5 wt% based on the weight of solids in the sizing agent (solids: substances other than water and solvent), particularly preferably 3 wt% or less. For example, when using "Epikote 828 (trade name)" supplied by Shell Chemical Co. having a viscosity of 120 to 150 poises at 25° C. and a molecular weight of 380, the number of moles of added ethylene oxide is suitably 20 to 25 and, when using "Epikote 1002" (trade name) having a viscosity of 1.65 to 2.75 poises at 25° C. as a 40 wt% solution of diethylene glycol monobutyl ether and a molecular weight of 1,060, and number of moles is suitably 30 to 50.

In the general formula (I),

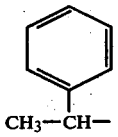

and —O—A—H may be in various positions of the tolylene group. Preferable substitution positions are shown below:

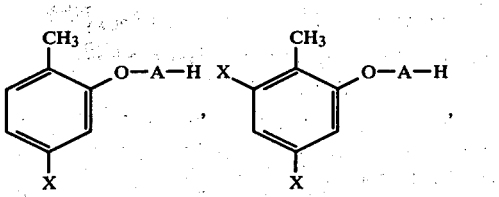

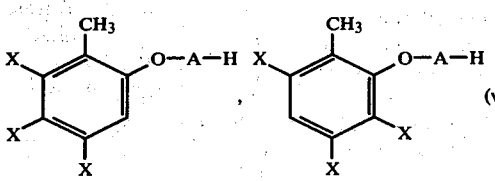

(wherein X represents

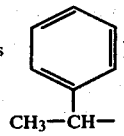

)

Illustrative of the compound represented by the general formula (I) include the following compounds:

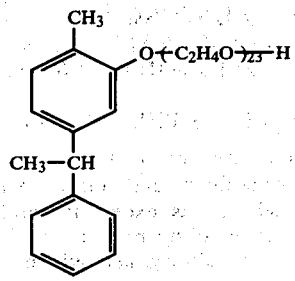

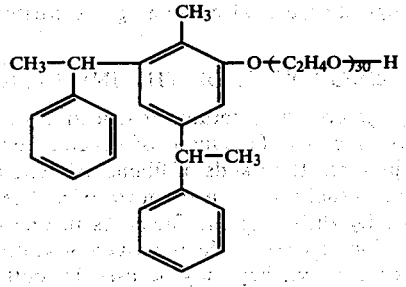

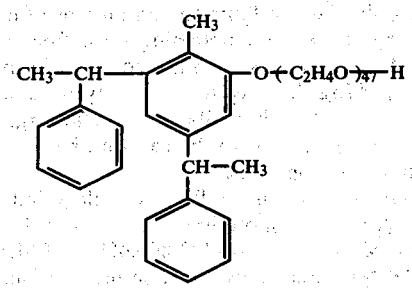

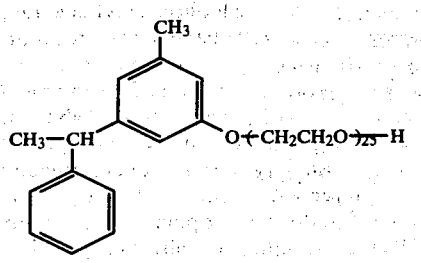

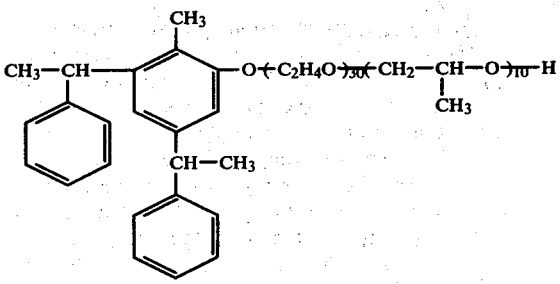

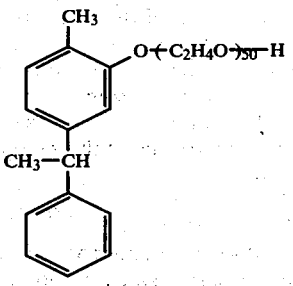

-continued

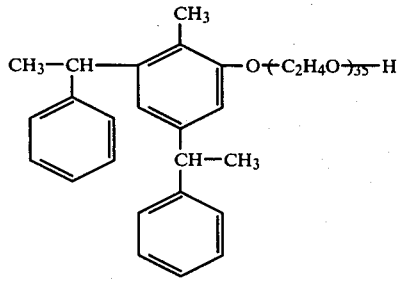

In the compound represented by the general formula (II), the number of moles of added ethylene oxide is within the range of 15 to 70, with 16 to 30 being particularly preferable. If less than 15 moles are added the emulsion tends to have poor emulsifying power, whereas if more than 70 are added the resulting emulsion tends to have poor stability. Substituent R is an alkyl group having 10 to 18, preferably 12 to 16 carbon atoms or a phenyl group substituted by such an alkyl group. The substituent may be positioned at any of the o-, m-, or p-positions. If the alkyl group has carbon atoms outside the above-described range, the resulting emulsion tends to have deteriorated stability. In order to obtain a sizing agent having a particularly good emulsion stability, p should be increased if q is a larger number. Like n and m described hereinbefore, the numbers of moles of added alkylene oxide can be experimentally determined.

Illustrative of the compound represented by the general formula (II) include the following compounds:

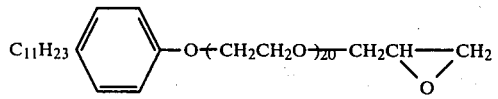

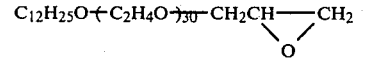

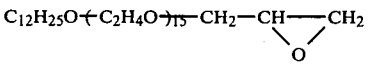

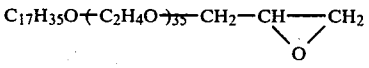

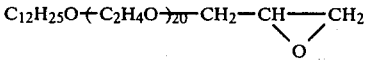

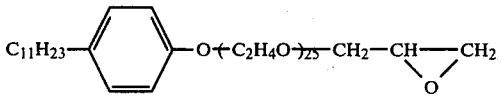

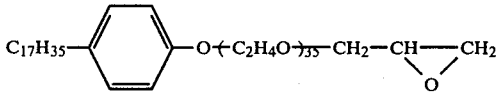

In the present invention, combined use of the compound of the general formula (I) and the compound of the general formula (II) is necessary. The lack of either of the compounds fails to attain desired emulsion stability. Particularly with a sizing agent having a low solid concentration (as has been mentioned hereinbefore), good emulsion stability cannot be attained when either of the two compounds is not used.

The proportion of the two compounds used is desirably adjusted as follows:

$$1 \leqq \frac{\text{weight of compound (I)}}{\text{weight of compound (II)}} \leqq 19$$

particularly preferably $$2 \leqq \frac{\text{weight of compound (I)}}{\text{weight of compound (II)}} \leqq 10$$

more preferably $$3.5 \leqq \frac{\text{weight of compound (I)}}{\text{weight of compound (II)}} \leqq 6.5$$

If the ratio of compound (I) to compound (II) is less than 1, emulsion stability is deteriorated. If the ratio of (I) to (II) is more than 19, emulsion stability is deteriorated and the physical properties of a composite material described hereinbefore containing carbon fibers treated with such a sizing agent can be deteriorated. Therefore, it is desirable to maintain the ratio of (I) to (II) as indicated above. The reason why the above-described mixing ratio of compound (I) to the compound (II) is preferable is believed to be as follows. Since compound (I) represented by the general formula (I) comprises hydrophilic groups of an ethylene oxide group and a hydroxy group and hydrophobic groups of

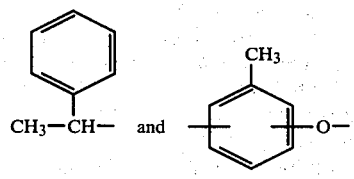

group, it is somewhat different in interfacial energy from an epoxy resin which is hydrophobic. However, compounds represented by the general formula (II) have an epoxy group at the terminal end, and hence have an interfacial energy just intermediate that of the epoxy resin and that of the compound represented by the general formula (I). Accordingly, compound (II) is considered to function so as to bind the compound (I) and the resin physicochemically. This seems to create excellent stability even at a low solid concentration (0.1 to 15 wt%) at which ordinary epoxy resin-containing emulsions are unstable.

The compound of the general formula (I) can be obtained by adding ethylene oxide to a reaction product between styrene and methylphenol, or by a dehydration reaction with a block polymer of ethylene oxide and propylene oxide. On the other hand, the compound represented by the general formula (II) can be obtained by reacting alkyl ether or alkyl-substituted phenyl ether with ethylene oxide, and reacting the terminal hydroxy group of the resulting ethylene oxide alkyl ether or ethylene oxide alkyl-substituted phenyl ether with epichlorohydrin.

Examples of epoxy resins incorporated in the sizing agent of the present invention include those which have been used for conventional sizing agents for carbon fibers. The epoxy resin used in the present invention may be a single copy resin, a mixture of two or more epoxy resins, or an epoxy resin or a mixture of two or more epoxy resins diluted with a diluent (diluent which liquefies a solid epoxy resin or reduces the viscosity of a highly viscous epoxy resin, as is described hereinafter). The epoxy resin, the mixture thereof and the epoxy resin diluted with a diluent have a viscosity of preferably 100 to 20,000 poises, more preferably 500 to 15,000 poises, at 45° C. Whe using carbon fibers treated with the sizing agent of the present invention for producing prepreg by impregnating the fibers with a resin, epoxy resins having a viscosity of 500 to 2,000 are preferable. When the fibers are used for producing woven fabric or felt, epoxy resins having a viscosity of 5,000 to 10,000 poises are preferable. If the viscosity of the epoxy resin, epoxy resin mixture, or diluted epoxy resin is less than 100 poises, the resulting sizing agent has a decreased ability with respect to imparting bundling properties to carbon fibers. However, if the viscosity is more than 20,000 poises, carbon fibers treated with such a sizing agent tend to fluff when handled.

Useful epoxy resins include, for example, glycidyl series epoxy resins such as bisphenol type epoxy resins obtained by the reaction between a bisphenol compound (e.g., bisphenol A, bisphenol F, 2,2'-bis(4-hydroxyphenyl)butane, 2,2'-bis(4-hydroxyphenyl)hexafluoropropane, etc.) and epichlorohydrin. Epoxy resins which have been found to be useful in practice include "Epikote 828" and "Epikote 1001" (trade names; supplied by Shell Chemical Co.), phenolic epoxy resins (e.g., epoxy resins obtained by the reaction between novolak type phenol resin and epichlorohydrin, specifically "Epikote 152" (trade name) and "Epikote 154" (trade name) supplied by Shell Chemical Co.), vinyl ester type epoxy resins (e.g., epoxy resins obtained by the reaction between a vinyl compound such as vinyl acetate, vinyl chloride, styrene or acrylonitrile and glycidyl methacrylate), ether type epoxy resins (e.g., mono-, di- or triglycidyl ethers of polyols, polyether polyols or polyhydric phenols), glycidylamine type epoxy resins (e.g., N,N,N',N'-tetraglycidyl-4,4'-diaminodiphenylmethane, N,N,N'-triglycidyl-4,4'-diaminodiphenylmethane, N,N,N',N'-tetraglycidyl-4,4'-diaminodiphenylethane, N,N,N'-triglycidyl-4,4'-diaminophenylethane, N,N,N',N'-tetraglycidyl-4,4'-diaminodiphenylpropane, N,N,N'-triglycidyl-4,4'-diaminoditoluylmethane, etc.), and the like; non-glycidyl series epoxy resins such as alicyclic epoxy resins (e.g., bis-2,3-epoxycyclopentyl ether, 1,4-bis(2,3-epoxypropoxy)cyclohexane, 1,4-bis(3,4-epoxybutoxy)-2-chlorocyclohexane, di(epoxycyclohexanecarboxylate) of aliphatic diol, alicyclic triepoxide, etc.), epoxidized polybutadiene (e.g., a reaction product between "BF-1000" (trade name; supplied by Adeka Argus Chemical Co., Ltd.) or "Hycar" (trade name; supplied by The B.F. Goodrich Co.) and an epoxy compound), epoxidized sorbitol, etc.; polyurethane-modified epoxy resins (e.g., ADEKA RESIN-EPU-4, -EPU-6 (trade name) supplied by Asahi Electro-Chemical Co., Ltd., etc.), and the mixtures of these resins.

Other ingredients may be added to the sizing agent of the present invention. For example, it is possible to add lubricants (e.g., higher aliphatic amides such as oleic acid amide, stearic acid amide, etc., higher aliphatic alcohols such as oleyl alcohol, stearyl alcohol, cetyl alcohol, etc., silicone oil, fluorine-containing compound, etc.), softening agents (e.g., polyoxyethylene stearic acid amide, polyoxyethylene stearyl ester, etc.), diluents described hereinbefore (e.g., reactive diluents such as phenyl glycidyl ether, cresyl glycidyl ether, ethylene glycol diglycidyl ether, trimethylolpropane triglycidyl ether, etc., and non-reactive diluents such as nonylphenol, tricresyl phosphate, etc.). These ingredients are added in proper amounts depending upon the end-use, with the total amount of the additives preferably being not more than 20 wt% based on the epoxy resin.

A compounding example of the sizing agent of the present invention is as follows: 1 to 50 parts by weight, preferably 5 to 15 parts by weight, of the compound of the general formula (I), 0.05 to 25 parts by weight, preferably 1 to 5 parts by weight, of the compound of the general formula (II), 50 to 99 parts by weight, preferably 80 to 95 parts by weight, of the epoxy resin and 0 to 25 parts by weight, preferably 2.5 to 10 parts by weight, of a solvent for the epoxy resin.

The process for preparing the sizing agent of the present invention is not particularly limited. It is possible to use generic emulsifying processes. A phase inversion emulsification process has been found to be the simplest process suited for the present invention. In accordance with this process, compound (I) and compound (II), epoxy resin and, if necessary, additives are heated (40° to 120° C.) and mixed. The viscosity of this mixture for emulsification is preferably 100 to 1,000 poises, more preferably 500 to 700 poises, at 45° C. If necessary, the viscosity may be adjusted by adding a solvent for the epoxy resin such as acetone, methyl ethyl ketone, methyl cellosolve, propyl cellosolve, etc., in an amount within the scope of not more than 15 wt% based on the ingredients other than water and diluent. Water is then added thereto in portions under vigorous stirring to cause phase inversion emulsification to obtain an emulsion having a proper solid concentration. It is preferable to adjust the concentration to 30 to 60 weight%, and more preferable to 40 to 50 weight% when the emulsion is stocked. The solid concentration of the emulsion upon application is determined depending upon the end-use of the treated fibers. The solid concentration is usually 0.1 to 20 wt%, preferably 0.5 to 5 wt%.

The sizing agent of the present invention is applied to ordinary carbon fibers produced by heating a precursor of rayon, pitch or acrylic filaments to 1,000° to 1,500° C. to obtain carbon fibers or further to 1,500° to 3,000° C. to obtain graphite fibers (herein graphite fibers are referred to as carbon fibers). The fibers are generally produced as a bundle comprising 500 or more filaments. In the present invention, the sizing treatment is usually applied to strands composed of 500 to 100,000 filaments.

Conventional methods may be used to deposit the sizing agent of the present invention on carbon fibers. For example, it is possible to use roller-sizing method, roller-dipping method, spraying method, etc. After depositing the sizing agent at a temperature of generally 10° to 40° C., the water and solvent are removed by drying to complete the sizing treatment. Drying is conducted under such conditions that the epoxy resin is not hardened or decomposed, i.e., usually at about 80° to 200° C. for about 0.1 to about 10 minutes. The amount of deposited sizing agent is usually 0.1 to 10 wt% as solids (compounds (I) and (II) and epoxy resin), preferably 0.5 to 5 wt%, based on the weight of carbon fibers treated.

Fibers treated with the sizing agent of the present invention are preferably used to obtain prepreg by impregnating a thermosetting resin such as an epoxy resin, a phenol resin, a polyimido resin and an unsaturated polyester resin, or a thermoplastic resin such as a polyamide resin and a polyester resin to obtain a fiber reinforced composite which is useful for obtaining a heat mold product.

The present invention will now be described in more detail by the following examples and comparative examples which, however, are not to be construed as limiting the present invention in any way. In the following examples and comparative examples, "parts" and "%" are by weight unless otherwise specified.

EXAMPLE 1

(A) Preparation of Sizing Agent Emulsion:

| | Compounding parts |
|---|---|
| (1) Epikote 828 (trade name of epoxy resin made by Shell Chemical Co.) | 70 parts |
| (2) Epikote 1001 (trade name of epoxy resin made by Shell Chemical Co.) | 20 parts |
| (3) 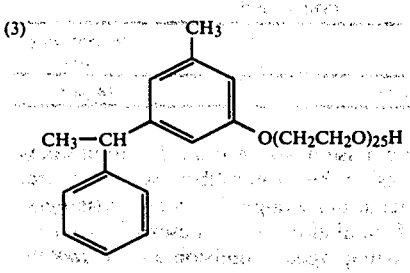 | 7 parts |
| (4) $C_{12}H_{25}O(C_2H_4O)_{15}-CH_2-CH(O)-CH_2$ | 3 parts |
| (5) Water | 90 parts |
| (6) Methyl ethyl ketone | 10 parts |

Of the above-described ingredients, (1), (2), (3), (4) and (6) were previously heated to 50° C., mixed and placed in a vessel. The mixture was then allowed to stand to defoam. The defoamed mixture was vigorously stirred at 50,000 rpm in a high speed homogenizer at 50° to 60° C., and water (5) was added thereto by portions (at a rate of 2 to 4 parts by weight/minute) until phase inversion took place. After the phase inversion, the stirring speed was gradually reduced, during which time the remaining water (5) was added thereto to dilute. Thus, there was obtained a milky white emulsion having a solid concentration of 50%. When this emulsion was further diluted with water to 5% and left at room temperature for ten days, only 3% of the solids in the emulsion precipitated, thus emulsion stability was found to be good. Also, when the emulsion solids were oven-dried at 105° C. and treated in the air at 180° C. for 1 hour, the loss in weight was as low as 0.1%.

(B) Sizing of Carbon Fibers and Preparation of Molding Using the Sized Carbon Fibers Non-sized carbon fibers obtained by calcining at 1,300° C. ("Besfight" (trade name; made by Toho Beslon Co., Ltd.; 6,000 filaments; tensile strength: 350 kg/mm$^2$; tensile modulus: 23,700 kg/mm$^2$) were passed through a bath of the emulsion obtained in (A) and diluted with water to a solid concentration of 20 g/liter, and were dried at 130° C. for 2 minutes in air to remove water. The amount of deposited emulsion as solids was 1.4% based on the carbon fibers.

When the thus-obtained sizing-treated carbon fibers were heat-treated in the air at 180° C. for 1 hour to measure the loss in weight on heating, it was determined to be 0.05%. Thus, they showed excellent heat stability. The thus-sized carbon fibers were passed between two sheets of urethane sponge (10 mm thick) under a pressure of 6.1 g/cm$^2$ at a speed of 15 m/min. This was done in order to measure the weight of fluffs which was found to be as small as 10 mg/100 m carbon fiber.

A prepreg was then prepared using the resulting carbon fibers and a matrix of a resin system composed of 70 parts of Epikote 828 described hereinbefore, 30 parts of EPN-1138 (trade name of epoxy resin, made by Ciba Geigy Co.), and 3 parts of boron trifluoride monoethylamine and disposing the carbon fibers in one direction. Penetrating properties of the resin into the space between carbon fibers was so good that a good prepreg was prepared in a short time.

12 Layers of the thus-prepared prepregs were laminated in a molded thickness of 3 mm, disposing the carbon fibers in one direction, followed by compression molding in a metal mold at 130° C. and 7 kg/cm$^2$ for 1.5 hours to prepare a bar of carbon fiber reinforced plastics (CFRP). Interlaminar shear strength (ILSS) of the CFRP measured at room temperature (25° C.) according to ASTM D-2344 was 10.9 kg/mm$^2$, and that measured at 80° C. was 8.1 kg/mm$^2$.

These values were the same as the ILSS values of CFRP obtained by using carbon fibers having deposited thereon 1.4% of sizing solids obtained by sizing carbon fibers in a solution type sizing agent containing the same expoxy resin (1) (70 parts) and (2) (20 parts) as shown in (A) and acetone (4590 parts). Thus, high adhesion was attained.

EXAMPLE 2

| | Compounding parts |
|---|---|
| (1) Epikote 815 (trade name of epoxy resin made by Shell Chemical Co.) | 50 parts |
| (2) Epikote 152 (trade name of epoxy resin made by Shell Chemical Co.) | 40 parts |

-continued

| | Compounding parts |
|---|---|
| (3) 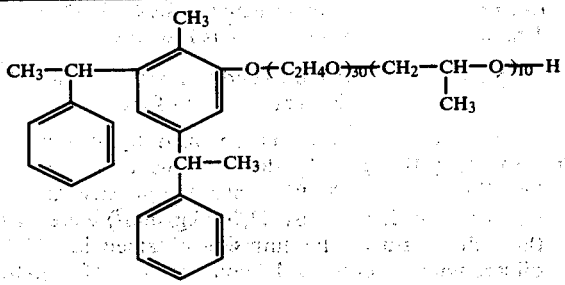 | 8 parts |
| (4) 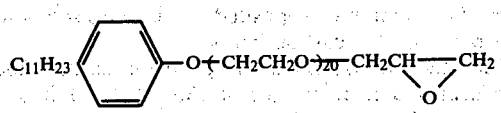 | 2 parts |
| (5) Water | 90 parts |
| (6) Methyl cellosolve | 10 parts |

A sizing agent (solids: 50%) of the above-described formulation was prepared and carbon fibers were treated therewith in the same manner as in Example 1, followed by forming prepregs and a CFRP bar therefrom. The CFRP showed ILSS of 10.8 kg/mm$^2$ at room temperature and 8.0 kg/mm$^2$ at 80° C., thus showing good composite material properties.

When a 5% sizing emulsion solution of the above-described composition was left at room temperature for ten days, 2% of the solids precipitated.

When this emulsion type sizing agent was oven-dried at 105° C. and heat-treated in the air at 180° C. for 1 hour the loss of weight was as low as 0.1%. Also, carbon fibers treated with the sizing agent showed a loss in weight on heating under the same conditions of 0.08%, thus showing excellent heat stability. In addition, the amount of fluffs measured in the same manner as in Example 1 was 9 mg/100 m carbon fiber, thus good bundling properties were observed.

EXAMPLE 3

| | Compounding parts |
|---|---|
| (1) Epoxidized polybutadiene (trade name: BF-1000; made by Adeka Argus Chemical Co., Ltd.) | 50 parts |
| (2) Epikote 828 | 30 parts |
| (3) 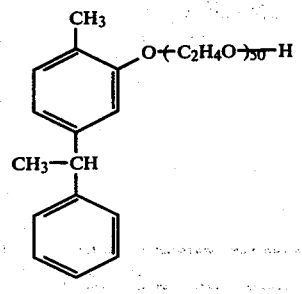 | 15 parts |
| (4) $C_{12}H_{25}O(C_2H_4O)_{30}CH_2CH(O)CH_2$ | 5 parts |
| (5) Water | 92 parts |

-continued

| | Compounding parts |
|---|---|
| (6) Isopropyl cellosolve | 8 parts |

A sizing agent emulsion, sizing-treated carbon fibers, and a CFRP bar using the carbon fibers were prepared in the same manner as in Example 1 except for changing the sizing agent formulation to that described above.

When a 5% sizing agent emulsion of the above-described composition was left for 10 days at room temperature, 4.5% of the solids were precipitated. When the emulsion type sizing agent was oven-dried at 105° C. and heat-treated in the air at 180° C. for 1 hour, the loss of weight on heating was 0.15%. Also, carbon fibers treated with the sizing agent showed a loss of weight on heating at 180° C. for 1 hour of 0.06%, and the amount of fluffs of the carbon fibers was 5 mg/100 m carbon fiber. Further, the resulting CFRP bar had an ILSS value of 10.7 kg/mm$^2$ at room temperature and 7.7 kg/mm$^2$ at 80° C.

EXAMPLE 4

| | Compounding parts |
|---|---|
| (1) ADEKA RESIN EPU-6 (made by Asahi Electro-Chemical Co., Ltd.) | 40 parts |
| (2) MY-720 (trade name of an epoxy resin made by Ciba Geigy Co.) | 40 parts |
| (3) ADEKA RESIN EPU-4 | 8 parts |
| (4) 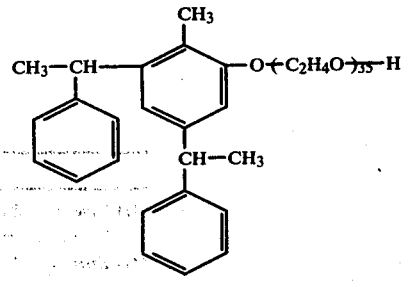 | 10 parts |

-continued

| | Compounding parts |
|---|---|
| (5) $C_{17}H_{35}O(C_2H_4O)_{35}CH_2CH(O)CH_2$ | 2 parts |
| (6) Water | 92 parts |
| (7) Isopropyl cellosolve | 8 parts |

A sizing agent emulsion, sizing-treated carbon fibers, and a CFRP bar using the carbon fibers were prepared in the same manner as in Example 1 except for changing the sizing agent formulation to that described above.

When the sizing agent emulsion of the above-described composition was left for 10 days at room temperature, 3.7% of the solids were precipitated and, when the emulsion sizing agent was oven-dried at 105° C. and heat-treated in the air at 180° C. for 1 hour, the weight loss from heating was 0.12%. Also, carbon fibers treated with the sizing agent showed a loss in weight on heating at 180° C. for 1 hour of 0.50%, and the amount of fluffs of the carbon fibers was 8 mg/100 m carbon fiber. Further, the resulting CFRP bar had an ILSS value of 10.6 kg/mm$^2$ at room temperature and 7.7 kg/mm$^2$ at 80° C.

COMPARATIVE EXAMPLE 1

Emulsification was conducted in the same manner as in Example 1 except for changing the sizing ingredients (3) and (4) in Example 1-(A) to those given in the following table to measure the amount of precipitated particles of the emulsions.

TABLE 1

| | Run No. | |
|---|---|---|
| | No. 1 | No. 2 |
| Compound (3) used in Example 1 | 10 parts | 0 part |
| Compound (4) used in Example 1 | 0 part | 10 parts |
| Amount of precipitated emulsion particles | 9% | 92% |

Further, carbon fibers were treated with the composition of Run No. 1 in the same manner as in Example 1-(B), and a CFRP bar was prepared therefrom. This CFRP bar showed an ILSS value of 9.8 kg/mm$^2$ at room temperature and 6.8 kg/mm$^2$ in 80° C. air. From these results, it is seen that sizing agents not containing either of the compounds (I) or (II) formed a large amount of an emulsion particle precipitate, thus lacking emulsion stability, leading to low ILSS of CFRP and adversely affecting physical properties of CFRP.

COMPARATIVE EXAMPLE 2

Emulsions and CFRP bars were prepared in the same manner as in Example 1 except for changing the sizing agent ingredients (3) and (4) to a popularly known surfactant, NOIGEN EA 190 (trade name of polyethylene glycol (adduct of 25 moles of ethylene oxide) lauryl ether; made by Dai-ichi Kogyo Seiyaku Co., Ltd.). These were tested in the same manner as in Example 1 with respect to the same items to obtain the results shown in Table 2.

From the results given in Table 2, it is seen that the use of the conventionally used surfactant provided inferior results to those in Example 1 with respect to emulsion stability, physical properties of CFRPs, and sizing effect.

TABLE 2

| | Run No. | |
|---|---|---|
| | No. 3 | No. 4 |
| NOIGEN EA 190 in place of Compound (3) in Example 1 | 10 parts | 7 parts |
| Compound (4) in Example 1 | 0 part | 3 parts |
| Amount of precipitated emulsion particles | 18% | 17% |
| Loss in weight of emulsion solids on heating for 1 hour at 180° C. in the air | 1.6% | 1.7% |
| ILSS of CFRP | | |
| at room temperature | 9.5 | 9.7 |
| at 80° C. | 6.7 | 6.9 |
| Fluffs of sized carbon fibers (amount of deposited sizing agent: 1.5%) | 21 mg/100 m-CF | 24 mg/100 m-CF |

COMPARATIVE EXAMPLE 3

CFRPs were prepared in the same manner as in Example 1 except for changing the sizing agent ingredients (3) and (4) in Example 1-(A) to 10 parts of

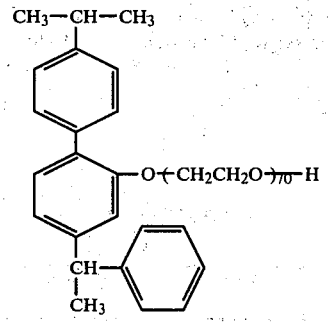

(made by Matsumoto Yushi Co., Ltd.). The sizing emulsion containing 5% solids formed a precipitate of 23% of the contained solids (after leaving for 10 days at room temperature), and the sized carbon fibers showed a loss in weight on heating at 180° C. for 1 hour in the air of 1.1% and formed fluffs of 23 mg/100 m carbon fiber. CFRP had an ILSS value of 9.8 kg/mm$^2$ at room temperature and 7.0 kg/mm$^2$ at 80° C. Thus, the results are inferior to those of Example 1 in accordance with the present invention with respect to all factors measured.

COMPARATIVE EXAMPLE 4

A sizing emulsion, sized carbon fibers, and CFRP were prepared in the same manner as in Example 1 except for changing the sizing ingredient (3) in Example

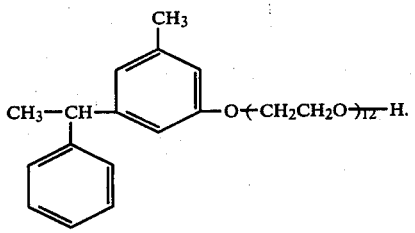

The sizing emulsion solution containing 5% solids formed a precipitate of 38% solids (after leaving for 10 days at room temperature), and the loss in weight of the sizing agent solids (oven-dried) on heating at 180° C. for 1 hour was 0.21%. The amount of fluffs of sized carbon fibers was 30 mg/100 m carbon fibers, and CFRP had an ILSS value of 9.5 kg/mm$^2$ at room temperature, and 6.9 kg/mm$^2$ at 80° C. Thus, where the number of moles of added ethylene oxide fell below the range specified in the present invention, the data were inferior to those in Example 1 with respect to all factors measured.

While the invention has been described in detail and with reference to specific embodiments thereof, it will be apparent to one skilled in the art that various changes and modifications can be made therein without departing from the spirit and scope thereof.

What is claimed is:

1. An aqueous emulsion type sizing agent for carbon fibers, comprising:

a compound represented by the following general formula (I):

(I)

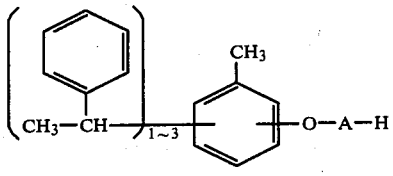

wherein A represents $(C_2H_4O)_l$ or $(C_2H_4O)_n(C_3H_6O)_m$ [l is 18 to 70; n is 18 to 70; and m is 2 to 50 ($1 \leqq n/m \leqq 35$)];

a compound represented by the following general formula (II):

(II)

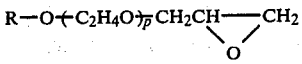

wherein R represents $C_qH_{2q+1}$ or

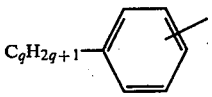

(q is 10 to 18; and p is 15 to 70); and an epoxy resin.

2. The sizing agent as claimed in claim 1, wherein the proportion of the compounds represented by the general formulae (I) and (II) is:

$$1 \leqq \frac{\text{weight of compound (I)}}{\text{weight of compound (II)}} \leqq 19$$

3. The sizing agent as claimed in claim 1, wherein said epoxy resin or its solution diluted with a diluent having a viscosity of 100 to 20,000 poises at 45° C.

4. The sizing agent as claimed in claim 1, wherein said epoxy resin is a bisphenol type, phenol type, vinyl ester type, ether type of glycidylamine type epoxy resin, an alicyclic epoxy resin, epoxidized polybutadiene, epoxidized sorbitol, polyurethane-modified epoxy resin, or a mixture thereof.

5. The sizing agent as claimed in claim 1, further comprising an additional ingredient selected from the group consisting of a lubricant, a softening agent, a diluent, and a solvent.

6. The sizing agent as claimed in claim 1, which contains 1 to 50 parts by weight of the compound of the general formula (I), 0.05 to 25 parts by weight of the compound (II), and 50 to 99 parts by weight of the epoxy resin.

7. The sizing agent as claimed in claim 1 having a solid concentration of 30 to 60 weight%.

8. The sizing agent as claimed in claim 1, having a solid concentration of 0.1 to 20 weight%.

9. The sizing agent as claimed in claim 6, further comprising 0 to 25 parts by weight of a solvent for the epoxy resin.

10. The sizing agent as claimed in claim 6, which contains at least one of a lubricant, softening agent, and diluent in a content of 20 wt% or less based on the epoxy resin.

11. The sizing agent as claimed in claim 1, wherein the amount of the diluent is such that the diluted epoxy resin has a viscosity of 100 to 20,000 poises at 45° C.

12. The sizing agent as claimed in claim 5, wherein the amount of the solvent is such that the mixture of the ingredients other than water shows a viscosity of 100 to 1,000 poises at 45° C.

13. A process for preparing an aqueous emulsion type sizing agent for carbon fibers, which comprises heating a compound represented by the following general formula (I):

(I)

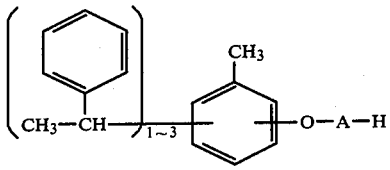

wherein A represents $(C_2H_4O)_l$ or $(C_2H_4O)_n(C_3H_6O)_m$ [l is 18 to 70; n is 18 to 70; and m is 2 to 50 ($1 \leqq n/m \leqq 35$)];

a compound represented by the following general formula (II):

(II)

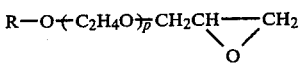

wherein R represents $C_qH_{2q+1}$ or

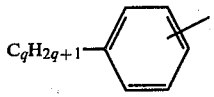

(q is 10 to 18; and p is 15 to 70); and an epoxy resin;

mixing and adding thereto water to cause phase inversion emulsification.

14. The process as claimed in claim 13, wherein the compounds represented by the general formulae (I) and (II), epoxy resin, are combined with an additional compound selected from the group consisting of a lubricant, a diluent, and a softening agent.

15. The process as claimed in claim 13, wherein the heating temperature is 40° to 120° C.

16. The process as claimed in claim 13, wherein a solvent is added to the mixture in order to adjust the viscosity of the mixture to 100 to 1,000 poises at 45° C.

17. A method for sizing carbon fibers, comprising: depositing on the fibers a sizing agent containing:

a compound represented by the following general formula (I):

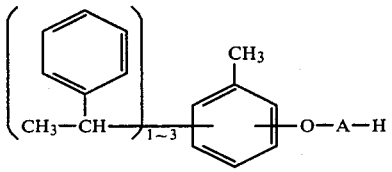

(I)

wherein A represents $(C_2H_4O)_l$ or $(C_2H_4O)_n(C_3H_6O)_m$ [l is 18 to 70; n is 18 to 70; and m is 2 to 50 ($1 \leqq n/m \leqq 35$)];

a compound represented by the following general formula (II):

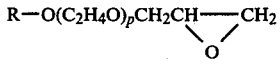

(II)

wherein R represents $C_qH_{2q+1}$ or

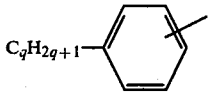

(q is 10 to 18; and p is 15 to 70); and an epoxy resin.

18. The sizing method as claimed in claim 17, wherein the deposition is conducted at 10° to 40° C., followed by drying at 80° to 200° C. for 0.1 to 10 minutes.

19. The sizing method as claimed in claim 17, wherein the solid concentration of the sizing agent is 0.1 to 20 wt%.

20. The sizing method as claimed in claim 17, wherein solids of the sizing agent are deposited on the carbon fibers in an amount of 0.1 to 10 wt% based on the weight of the carbon fibers.

* * * * *